US005931628A

United States Patent [19]

Christenson

[11] Patent Number: 5,931,628

[45] **Date of Patent: *Aug. 3, 1999**

[54] MANUAL/AUTOMATED SIDE LOADER

[75] Inventor: Ronald E. Christenson, Parsons, Tenn.

[73] Assignee: McNeilus Truck and Manufacturing, Inc., Dodge Center, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/907,253

[22] Filed: Aug. 6, 1997

Related U.S. Application Data

[63] Continuation of application No. 08/411,480, Mar. 28, 1995, abandoned.

[51] Int. Cl.[6] ..... B65F 3/04

[52] U.S. Cl. ..... 414/408; 414/406; 414/525.2

[58] Field of Search ..... 414/406, 408, 414/525.2, 419, 421, 547; 298/22 R, 23 MD

[56] References Cited

U.S. PATENT DOCUMENTS

| | | | |
|---|---|---|---|
| Re. 34,292 | 6/1993 | Bingman et al. . | |
| D. 329,829 | 9/1992 | Mangino et al. . | |
| 3,286,860 | 11/1966 | Naab . | |
| 3,484,006 | 12/1969 | Burke . | |
| 3,804,277 | 4/1974 | Brown et al. . | |
| 3,841,508 | 10/1974 | Ebeling et al. . | |
| 3,894,642 | 7/1975 | Shive . | |
| 3,910,434 | 10/1975 | Ebeling et al. . | |
| 3,921,839 | 11/1975 | Herpich | 414/408 X |
| 3,944,092 | 3/1976 | Ebeling et al. . | |
| 4,057,010 | 11/1977 | Smith . | |
| 4,057,156 | 11/1977 | Thompson et al. . | |
| 4,090,626 | 5/1978 | Ebeling et al. . | |
| 4,175,903 | 11/1979 | Carson . | |
| 4,227,849 | 10/1980 | Worthington . | |
| 4,230,359 | 10/1980 | Smith | 414/408 X |
| 4,239,437 | 12/1980 | Naab . | |
| 4,310,279 | 1/1982 | Johnston | 414/408 |
| 4,365,922 | 12/1982 | Borders . | |
| 4,401,407 | 8/1983 | Breckenridge . | |
| 4,422,814 | 12/1983 | Borders . | |
| 4,427,333 | 1/1984 | Ebeling . | |
| 4,461,608 | 7/1984 | Boda . | |
| 4,479,751 | 10/1984 | Wyman et al. . | |
| 4,543,028 | 9/1985 | Bell et al. . | |
| 4,552,500 | 11/1985 | Ghibaudo et al. | 414/408 |

(List continued on next page.)

FOREIGN PATENT DOCUMENTS

| | | | |
|---|---|---|---|
| A-6023190 | 2/1991 | Australia . | |
| B-4192193 | 5/1994 | Australia . | |
| A20312900 | 4/1989 | European Pat. Off. . | |
| 3-138201 | 6/1991 | Japan | 414/408 |
| WO9105721 | 5/1991 | WIPO . | |
| WO9201612 | 2/1992 | WIPO . | |
| WO9421540 | 9/1994 | WIPO . | |

*Primary Examiner*—Stephen T. Gordon
*Attorney, Agent, or Firm*—Nikolai, Mersereau & Dietz, PA

[57] ABSTRACT

A side loading refuse vehicle has a forward receiving hopper and a storage compartment wherein the floor of the receiving hopper is dropped to a relatively lower level than the floor of the storage compartment. The storage compartment and the receiving hopper floors are connected by a ramped floor. The material receiving opening in the receiving hopper is at a correspondingly lower level to make manual loading easier. The side loading refuse vehicle also includes a chassis having a ramped portion and a dropped chassis for supporting the ramped floor and receiving hopper. A mechanized lifting and emptying apparatus is situated on one side of the receiving hopper such that a container of interest may be engaged on that side and emptied through the material receiving opening into the receiving hopper. The mechanized lifting and emptying apparatus includes a telescoping boom holding a supporting arm and a container grabber for engaging a container of interest.

11 Claims, 18 Drawing Sheets

U.S. PATENT DOCUMENTS 4,566,840 1/1986 Smith .
4,613,271 9/1986 Naab .
4,669,940 6/1987 Englehardt et al. .
4,708,570 11/1987 Smith et al. .
4,715,767 12/1987 Edelhoff et al. .
4,722,658 2/1988 Würtz et al. .
4,726,726 2/1988 Dossena et al. .
4,741,658 5/1988 Zalinka et al. .
4,844,682 7/1989 Edelhoff .
4,868,796 9/1989 Ahrens et al. .
4,872,801 10/1989 Yeazel et al. .
4,889,462 12/1989 Naab et al. .
4,909,564 3/1990 Pfeifer et al. .
4,960,355 10/1990 Worthington ..... 414/408
4,966,514 10/1990 Knapp .
4,978,269 12/1990 Niederer ..... 414/408 X
4,978,271 12/1990 Seader .
4,983,092 1/1991 Richards .
4,986,074 1/1991 Hahmann et al. .
4,989,917 2/1991 Schmidt, Jr. .
5,002,450 3/1991 Naab .
5,006,030 4/1991 Smith et al. .
5,007,786 4/1991 Bingman .
5,018,929 5/1991 Carson .
5,024,573 6/1991 Redding et al. .
5,026,104 6/1991 Pickrell .
5,033,930 7/1991 Krauss .
5,035,563 7/1991 Mezey .
5,044,863 9/1991 LaBass et al. .
5,049,026 9/1991 Bingman et al. .
5,056,979 10/1991 Niederer et al. .
5,059,081 10/1991 Brown et al. .
5,064,332 11/1991 Edelhoff et al. .
5,071,303 12/1991 Carson .
5,071,307 12/1991 Carson .
5,078,567 1/1992 Lombardo .
5,092,731 3/1992 Jones et al. ..... 414/406
5,094,582 3/1992 Molzhon .
5,098,250 3/1992 Carson .
5,114,304 5/1992 Edelhoff et al. .
5,122,025 6/1992 Glomski .
5,163,805 11/1992 Mezey .
5,205,698 4/1993 Mezey .
5,209,537 5/1993 Smith et al. .
5,215,423 6/1993 Schulte-Hinsken et al. .
5,222,853 6/1993 Carson .
5,230,393 7/1993 Mezey .
5,252,020 10/1993 Kinney et al. .
5,275,522 1/1994 Garrett, Jr. et al. .
5,288,196 2/1994 Horning et al. .
5,303,841 4/1994 Mezey .
5,308,211 5/1994 Bayne .
5,316,430 5/1994 Horning et al. .
5,330,308 7/1994 Armando et al. .
5,342,164 8/1994 Kinney et al. .
5,344,273 9/1994 Radlein ..... 414/406 X
5,360,310 11/1994 Jones et al. .
5,391,039 2/1995 Holtom .
5,505,576 4/1996 Sizemore et al. ..... 414/408 X

MANUAL/AUTOMATED SIDE LOADER

This is a continuation of application Ser. No. 08/411,480, filed on Mar. 28, 1995 now abandoned.

BACKGROUND OF THE INVENTION

I. Field of the Invention

This invention relates generally to load hauling vehicles and, more particularly, to a side loading refuse truck capable of both manual and automated loading. The truck is capable of accommodating a variety of automated lift and dump loading mechanisms and is provided with a receiving hopper floor which is lowered to facilitate manual loading.

II. Related Art

Side loading refuse vehicles of the conventional variety generally include a frame carrying a cab section in front of a receiving hopper and storage body. Refuse to be hauled is loaded into the receiving hopper as by dumping containers. A packer, which is usually hydraulically operated, compacts the material rearward into the storage compartment. Loading of the receiving hopper is accomplished from the top or through side openings, the bottoms of which typically begin at a height equal to or above the depth of the packer so that refuse will not spill out of the hopper as it is packed.

Generally, material holding containers, such as refuse cans or bins, must be lifted and tipped over the side walls of the receiving hopper and inverted to empty the contents into the hopper. U.S. Pat. No. 4,708,570, issued to Smith et al, shows a conventional automated side loading refuse truck including a mechanized arm and grabber for lifting and emptying refuse. containers into the receiving hopper. As shown, the container must be lifted and inverted over receiving hopper sides that are as high as the top of the refuse storage body.

Manual loading is almost impossible with such a set up and the mechanized arm must lift a container to be emptied quite high. The need exists to provide a side loading vehicle of the class which can also accommodate manual loading.

It is accordingly a principal object of the invention to provide an improved side loading refuse vehicle.

Another object of the invention is to provide an improved side loading refuse vehicle including an extensible mechanized container lifting and emptying apparatus.

Yet another object of the invention is to provide a side loading refuse vehicle having a recessed or dropped receiving hopper floor and chassis relative to a storage body floor and chassis to enable a material receiving opening to start correspondingly closer to the ground to facilitate the manual loading thereof.

A further object of the invention is to provide a side loading refuse vehicle including a receiving hopper having a floor and a storage body having a floor wherein the receiving hopper floor is lower than the storage body floor and also including an extensible mechanized container lifting and emptying apparatus addressing the side of the vehicle next to the curb.

A still further object of the invention is to provide a side loading refuse vehicle including a receiving hopper floor and chassis which is lower relative to a storage body floor and chassis wherein an extensible mechanized container lifting and emptying apparatus is positioned offset in a correspondingly lower material receiving opening to accommodate optional manual loading.

A yet still further object of the invention is to provide a side loading refuse vehicle having an extensible boom-carried mechanized container lifting and emptying apparatus for addressing one side of the vehicle and a conventional cart-tipping apparatus addressing the other.

Other objects, features and advantages of the present invention will become apparent to those skilled in the art through familiarity with the summary of the invention, detailed description, claims and drawings herein.

SUMMARY OF THE INVENTION

The foregoing objects of the present invention are among those attained by providing a side loading refuse vehicle including a receiving hopper and a storage body wherein the floor of the receiving hopper is dropped to a relatively lower level than the floor of the storage body. The floors are connected by a transitional portion that includes a ramped floor. A packer situated in the receiving hopper is built to push material loaded into the receiving hopper onto the ramped floor and into the storage body.

A material receiving opening is provided on at least one side of the vehicle receiving hopper and begins a minimum distance from the floor of the receiving hopper. This minimum distance is determined by the depth of the packer apparatus to prevent material from spilling out of the receiving hopper as it is compacted and pushed into the storage body. Reducing the distance of the receiving hopper floor from the ground enables the material receiving opening to begin at a correspondingly lower level. This makes it easier to load the receiving hopper either manually or with a mechanized apparatus.

The vehicle of the invention includes a chassis which supports the dedicated truck body. The truck body includes a storage compartment, a transitional portion and a receiving hopper which are normally constructed as a single unit but may be separable in certain embodiments. In the embodiment described herein, the shape of the chassis conforms to the floor of the truck body and is ramped to support the ramped floor of the transitional body portion and lowered or dropped to support the receiving hopper floor at the desired lower level. A conventional forward cab is attached to the supporting chassis and wheels are carried by the chassis in a conventional manner. In a preferred embodiment, the receiving hopper floor is dropped about 20 inches (51 cm).

In the embodiment described herein, the receiving hopper is built as one unit with the storage compartment and the transitional or intermediate body portion. The hopper and body portions may be built as separate units which are secured together and to the chassis during collection. The storage compartment is situated behind the receiving hopper and supported by the chassis portion which carries the rear wheels of the load hauling vehicle or refuse truck.

The storage compartment is typically pivotally attached to the chassis at the rear of the refuse truck and a tailgate is pivotally attached to the top of the storage compartment. The tailgate is opened and the truck body raised and tipped aft to unload. Of course, in other embodiments of the invention, the storage compartment may be detachable from the receiving hopper for unloading material and in still other embodiments, the entire truck body could be detachable from the chassis of the vehicle for unloading.

The mechanized container lifting and emptying apparatus includes an extendable or telescoping boom which is situated at the front of the refuse receiving hopper. One end of the telescoping boom which is operated by a fluid operated actuator, such as an hydraulic cylinder, extends beyond the side of the receiving hopper and carries a material container grabber or lifting and inverting apparatus.

In the vehicle of the invention, a material receiving opening begins at a position which is relatively close to the ground since the receiving hopper floor and underlying chassis are lower than the storage body floor and underlying chassis. This makes it easier to manually load refuse into the receiving hopper for subsequent packing into the storage body. The material receiving opening is wide enough to accommodate the material container lifting apparatus and a manual loading zone or opening alongside. This manual loading opening is, of course, correspondingly at a lower level than in conventional side loading refuse trucks.

The container lifting and emptying apparatus includes a container grabber or bin handler held by the telescoping boom substantially toward the middle of the material receiving opening. The container grabber or bin handler is attached to a support arm for lifting and emptying an engaged container into the receiving hopper.

The container grabber or handler connected to the vehicle may be any of a variety of devices. The grabbers or other such devices for accessing, holding and manipulating a container of interest, include compound articulated arm grabbers operated by multiple fluid operated actuators. Examples of a type of grabber which is suitable for use in the present invention include those described and shown in U.S. application Ser. No. 08/342,752, filed Nov. 21, 1994, now abandoned, titled "Container Holding and Lifting Device", by Ronald E. Christenson, which is assigned to the same assignee as the present invention, and which is hereby deemed incorporated by reference in its entirety for any necessary purpose. The pivoting support arm attached to the grabber for lifting and emptying an engaged container also may be of any compatible variety and an example of one along with another example of a container lifting and holding apparatus which may be used with the present invention is shown and described in U.S. application Ser. No. 08/411,494, now abandoned, filed of even date "Tilting Bin Handler", by Ronald E. Christenson, which is assigned to the same assignee as the present invention, and which is also hereby incorporated by reference in its entirety for any necessary purpose to provide added details of both the support arm and the various bin handlers.

The packer situated in the receiving hopper may be of any variety compatible with the loading mechanism and body configuration including the conventional rectangular packing ram and packer assist panel type. In this situation, the telescoping boom is situated at the front of the receiving hopper above the retracted packing ram. The boom may be extended for the system to engage a container and retracted to lift and empty the container into the receiving hopper. The packer assist panel pivotally attached at the rear of the receiving hopper is then lowered to hold the refuse in the hopper as the packing ram is extended to push the material onto the ramp and into the storage compartment. A partial wall is included between the storage compartment and the receiving hopper to prevent compacted refuse from returning to the hopper.

Another packer type which may be used with the present invention includes a pivoting reciprocating packer paddle operable in a semicircular receiving hopper interior. A reciprocating packer of this variety is shown and described in U.S. application Ser. No. 08/374,813 filed Jan. 19, 1995, now abandoned, titled "Air Logic System for Side Loader", and assigned to the same assignee as the present invention, the disclosure of which is hereby deemed incorporated by reference in its entirety for any necessary purpose.

DETAILED DESCRIPTION

Figure 1:
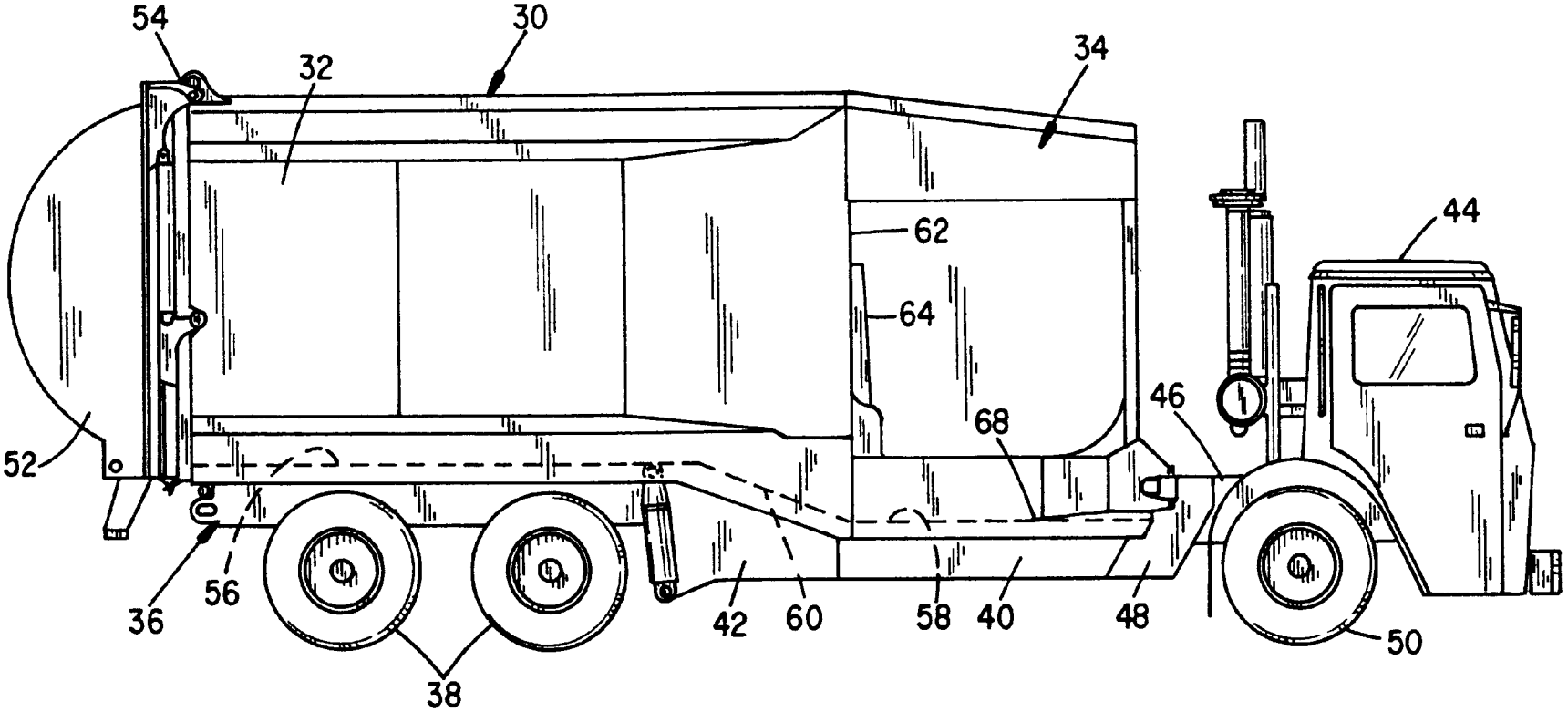
FIG. 1 is a side view of a side loading refuse truck showing a dropped receiving hopper floor and chassis in accordance with the present invention.

As shown in FIG. 1, a side loading refuse truck 30 of the present invention includes a rear storage volume or compartment 32 and a receiving hopper, indicated generally by the numeral 34. The storage compartment 32 is supported by a rear chassis section 36 which carries the suspension and rear wheels 38 of the vehicle or truck 30. A recessed or dropped chassis section 40 supports the receiving hopper 34 and is connected to the chassis section 36 with a ramped transition plate 42 which is connected to each chassis portion 36 and 40 such as with bolts and welding. A cab and engine section 44 is situated at the front of the vehicle 30 and supported by a cab chassis section 46 which is connected to the dropped chassis section 40 with a second splice plate 48 in a conventional manner. The cab chassis section 46 carries the front wheels 50 of the vehicle 30 and a tailgate 52 is attached to the top of the storage chamber 32 at pivot 54.

Figure 3:
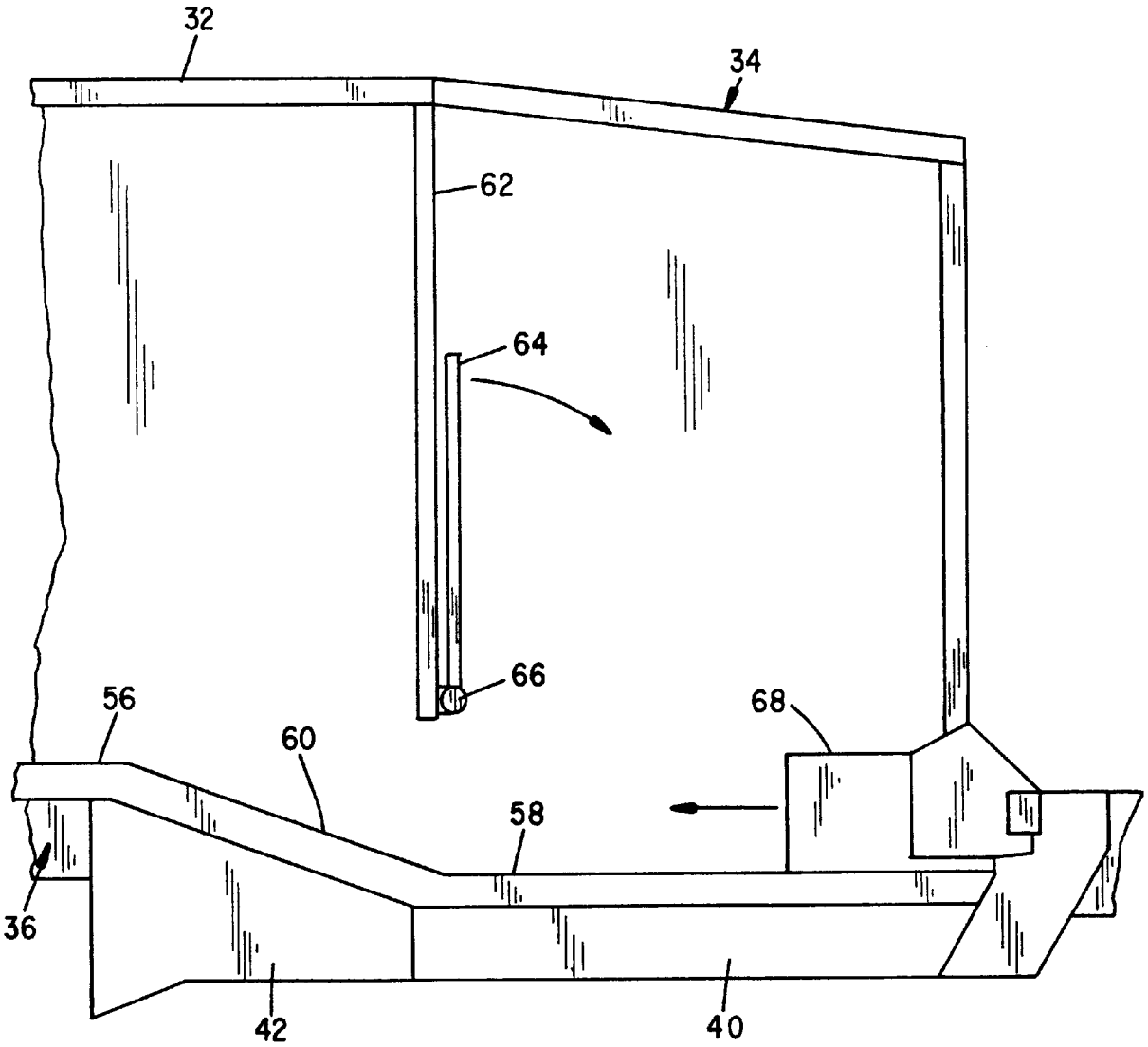
FIG. 3 is an enlarged fragmentary cross-section of inside the refuse vehicle of FIG. 1 showing the ramped floor and chassis transition between the storage body floor and the receiving hopper floor.

As shown in FIGS. 1 and 3, the storage compartment 32 has a floor 56 supported by the rear chassis section 36 and the receiving hopper 34 has a floor 58 supported by the dropped chassis section 40. The storage body floor 56 and the receiving hopper floor 58 are connected together by a ramp 60 intermediate the storage compartment 32 and the receiving hopper 34. A partial rear wall 62 separates the storage compartment 32 including the intermediate storage area having the ramp 60 from the receiving hopper 34. The partial rear wall 62 defines an opening between the rear wall 62 and the receiving hopper floor 58 at the occurrence of the ramp 60.

Figure 4:
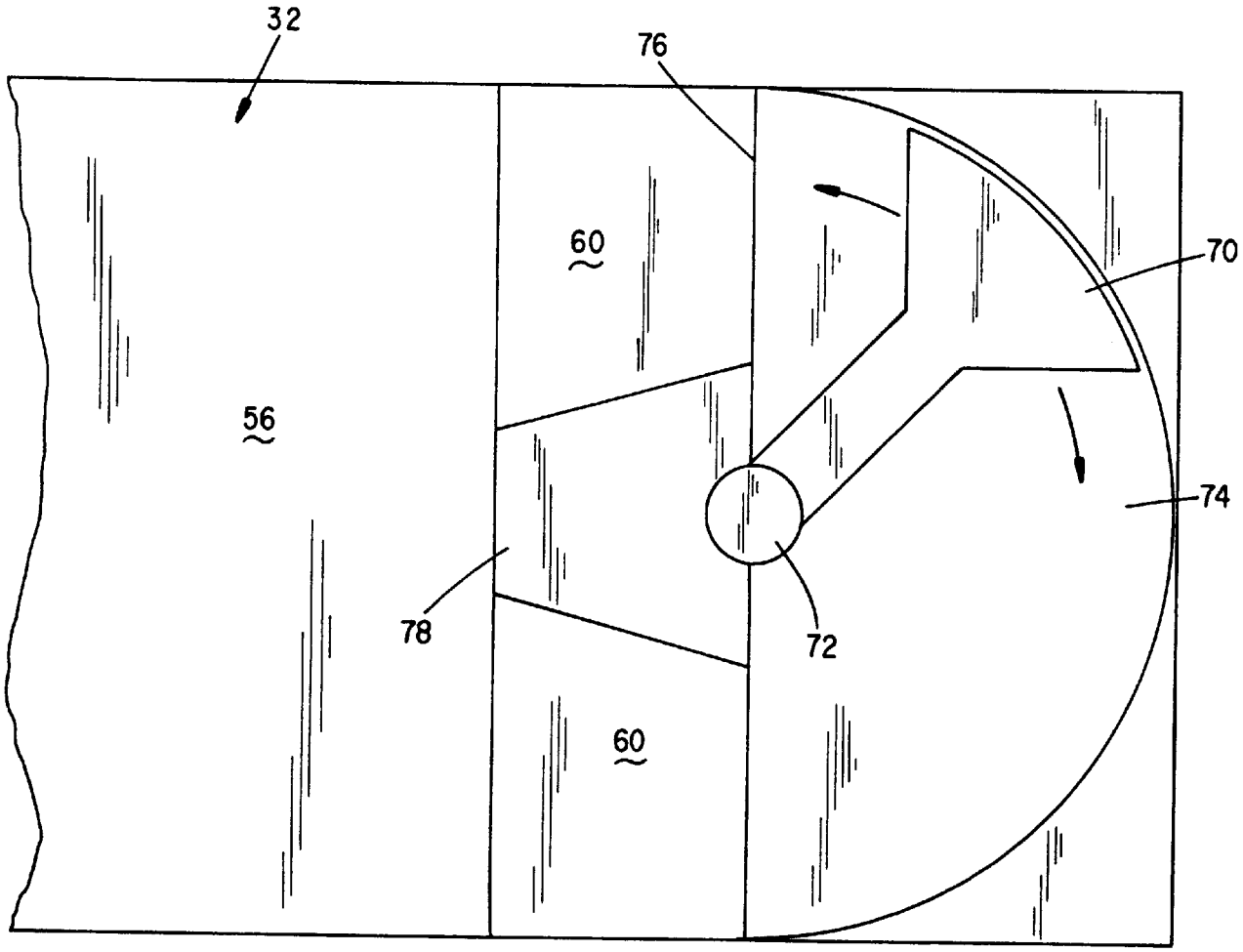
FIG. 4 is a diagrammatic top view of a receiving hopper and reciprocating packer paddle which may be used with the truck of the present invention.

In a conventional packer arrangement, an hydraulically operated packer assist panel 64 is lowered about pivot 66 to maintain refuse in the receiving hopper 34 and an hydraulically operated packing ran 68 extends to the rear of the receiving hopper 34 underneath the packer assist panel 64 to push refuse onto the ramp 60 and into the rear storage volume 32. Of course, as shown in FIG. 4, in another packer, the packer assist panel 64 and packing ran 68 may be replaced with a pivoting reciprocating packer paddle 70 whose pivoting axis 72 is positioned in the middle and at the rear of a semicircular receiving hopper 74. Partial rear wall 76 separates the rear storage area 32 from the receiving hopper 74 and includes openings on both sides of the pivoting axis 72. Block 78 prevents refuse from building up behind the pivoting axis 72 as the refuse is swept up the ramp 60 and into the storage body 32. A reciprocating packer paddle of this type is described and shown in the above incorporated U.S. application Ser. No. 08/374,813, titled "Air Logic System For Side Loader".

Figure 2:
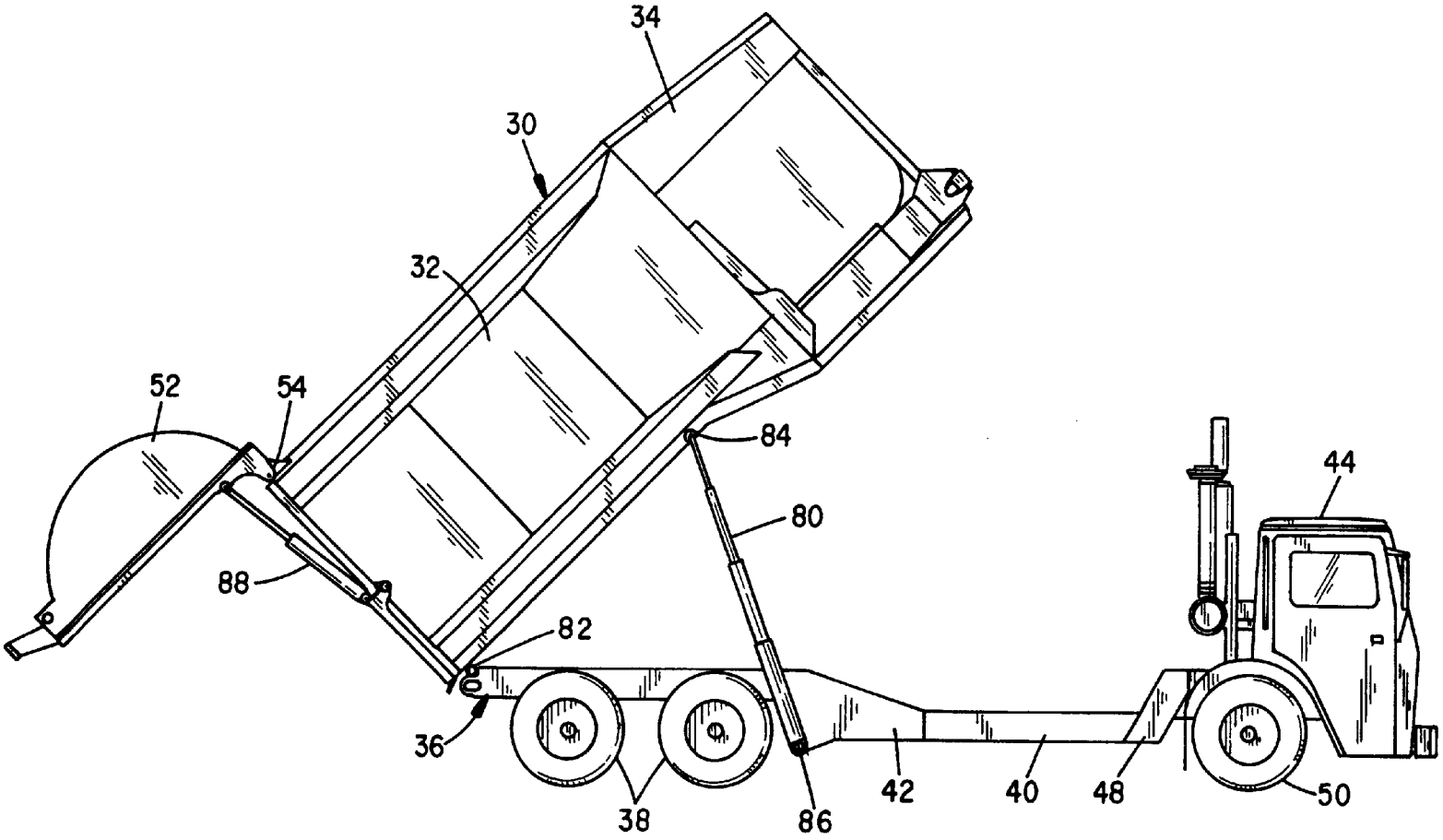
FIG. 2 is a side view of the refuse vehicle of FIG. 1 showing the tailgate opened and the truck body tilted for unloading.

As shown in FIG. 2, the side loading refuse vehicle 30 is unloaded by tilting the truck body with one or more hydraulic lifting cylinders 80 about pivot 82. The lifting cylinders 80 are themselves pivotally attached to the truck body at body pivot 84 and to the ramped transition plate 42 at 86. The tailgate 52 is opened by extending tailgate hydraulic cylinders, one of which is shown at 88.

Figure 5:
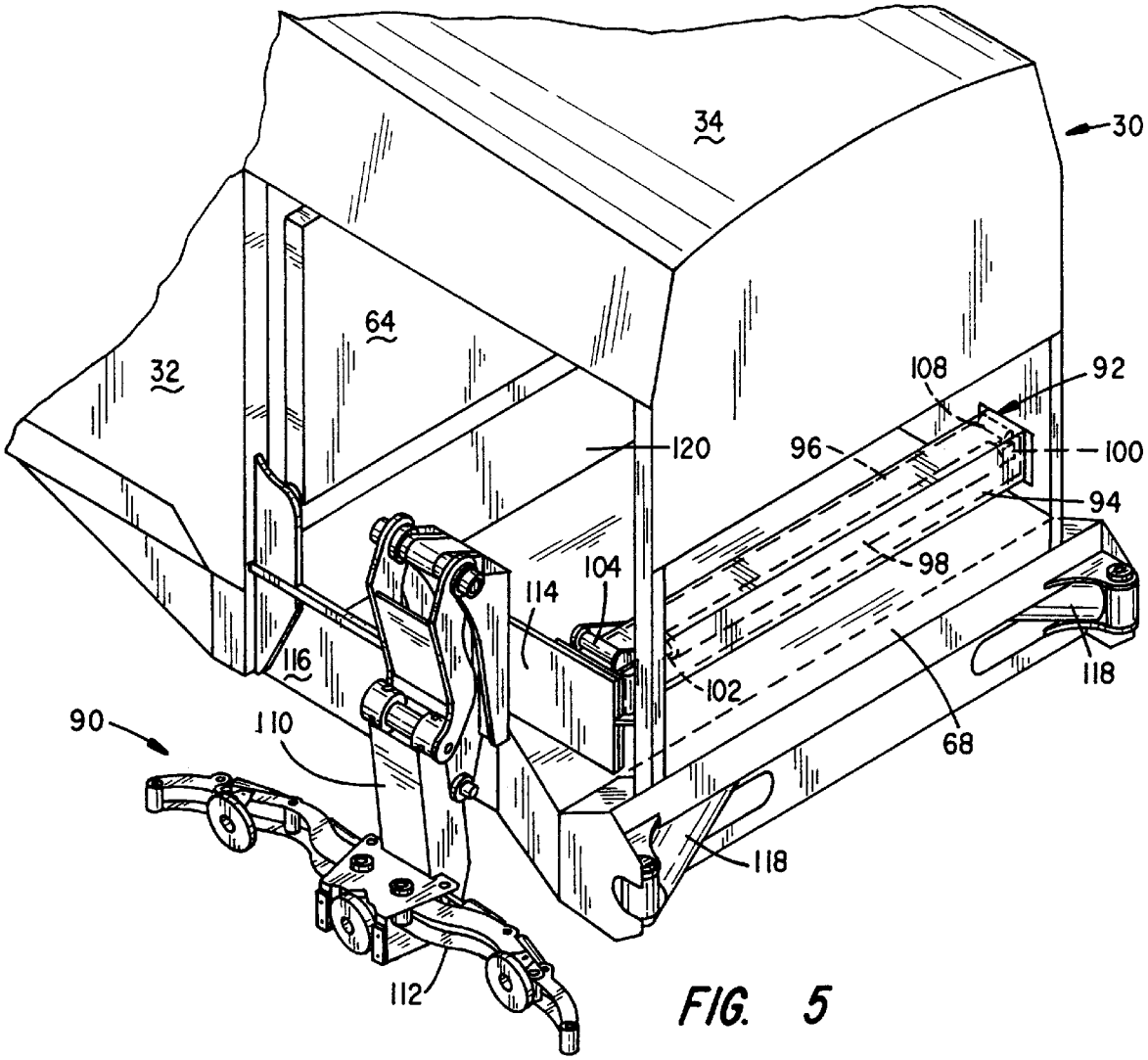
FIG. 5 is an enlarged fragmentary perspective view of the receiving hopper including a mechanized lifting and inverting apparatus.
Figure 6:
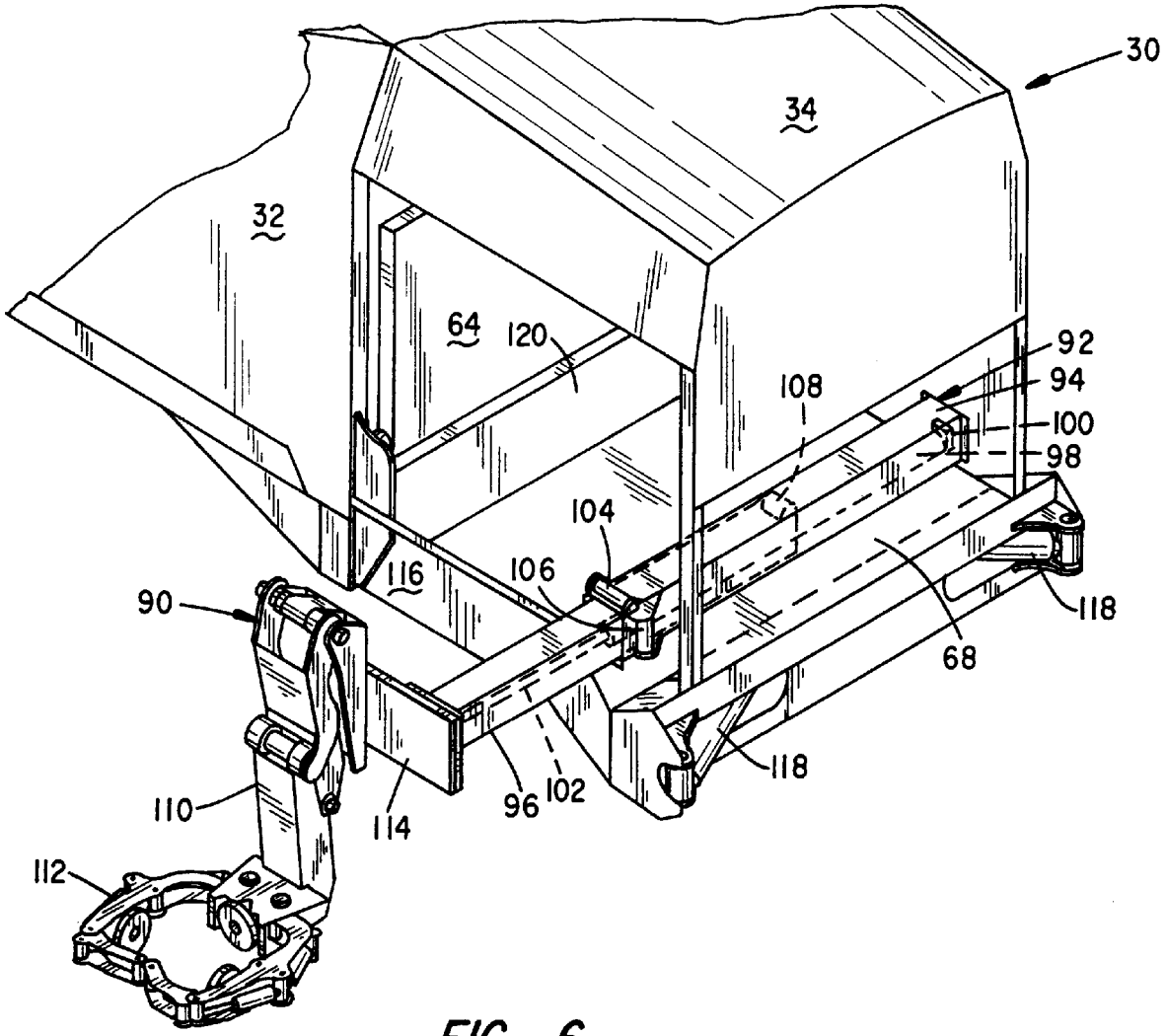
FIG. 6 is a view similar to FIG. 5 showing a telescoping boom extending and a container grabber gripping.

As shown in FIGS. 5 and 6, the side loading refuse vehicle 30 of the present invention includes a mechanized lifting and emptying apparatus 90 which is situated in the receiving hopper 34. The mechanized apparatus may be of any variety and in the example shown herein the apparatus 90 includes a telescoping boom 92 which includes an outer boom arm 94 telescoped without an inner extendable boom arm 96. A support arm 110, which may be of any variety, is attached between the inner boom arm 96 and a container grabber 112, which may be of any variety, using an offset mounting plate 114. The offset mounting plate 114 shifts the center of the support arm 110 and the container grabber 112 toward the center of the receiving hopper 34. The extendable or telescoping boom 92 is attached at the front of the receiving hopper 34 such that refuse containers can be lifted and emptied by the mechanized apparatus 90 without being emptied onto the telescoping boom 92.

To operate the telescoping boom 92 an hydraulic cylinder 98 is attached to the outer boom arm 94 on one side of the vehicle 30 at cylinder connector joint 100. The rod 102 of the hydraulic cylinder 98 is connected on the other side of the vehicle 30 to the inner extendable boom arm 96. Guide rollers 104 and 106 are rotatably attached to the outer boom arm 94 on all four sides for guiding the travel of the inner boom arm 96 within the outer boom arm 94 as the hydraulic cylinder rod 102 is extended. A slide roller 108 is rotatably attached to the inner boom arm 96 inside the outer boom arm 94 to facilitate moving the inner boom arm 96.

In a conventional packing ran vehicle 30, the telescoping boom 92 is attached on the receiving hopper 34 above the packing ram 68. To pack material or refuse into the storage body 32, the packer assist panel 64 is lowered to just about even with receiving hopper side plate 116 and packing ram cylinders 118 are extended to operate the packing ram 68 and push refuse through the opening, depicted by the numeral 120, and onto the ramped floor 60.

The mechanized lifting and emptying apparatus 90 is retracted to a stowed position, FIG. 5, by retracting the hydraulic cylinder 98 of the telescoping boom arm 92 to retract the inner boom arm 96 and hold the support arm 110 and container grabber 112 next to the side of the receiving hopper 34. In the stowed position, the arms of the container grabber 112 are opened. To engage containers containing refuse, the telescoping boom arm 92 is extended and the container grabber 112 is operated to close around a container of interest, FIG. 6. A telescoping boom arm 92 and support arm 110 of a variety which may be used in the present invention is described in the above-mentioned U.S. application Ser. No. 08/411,494, titled "Tilting Bin Handler".

Figure 7:
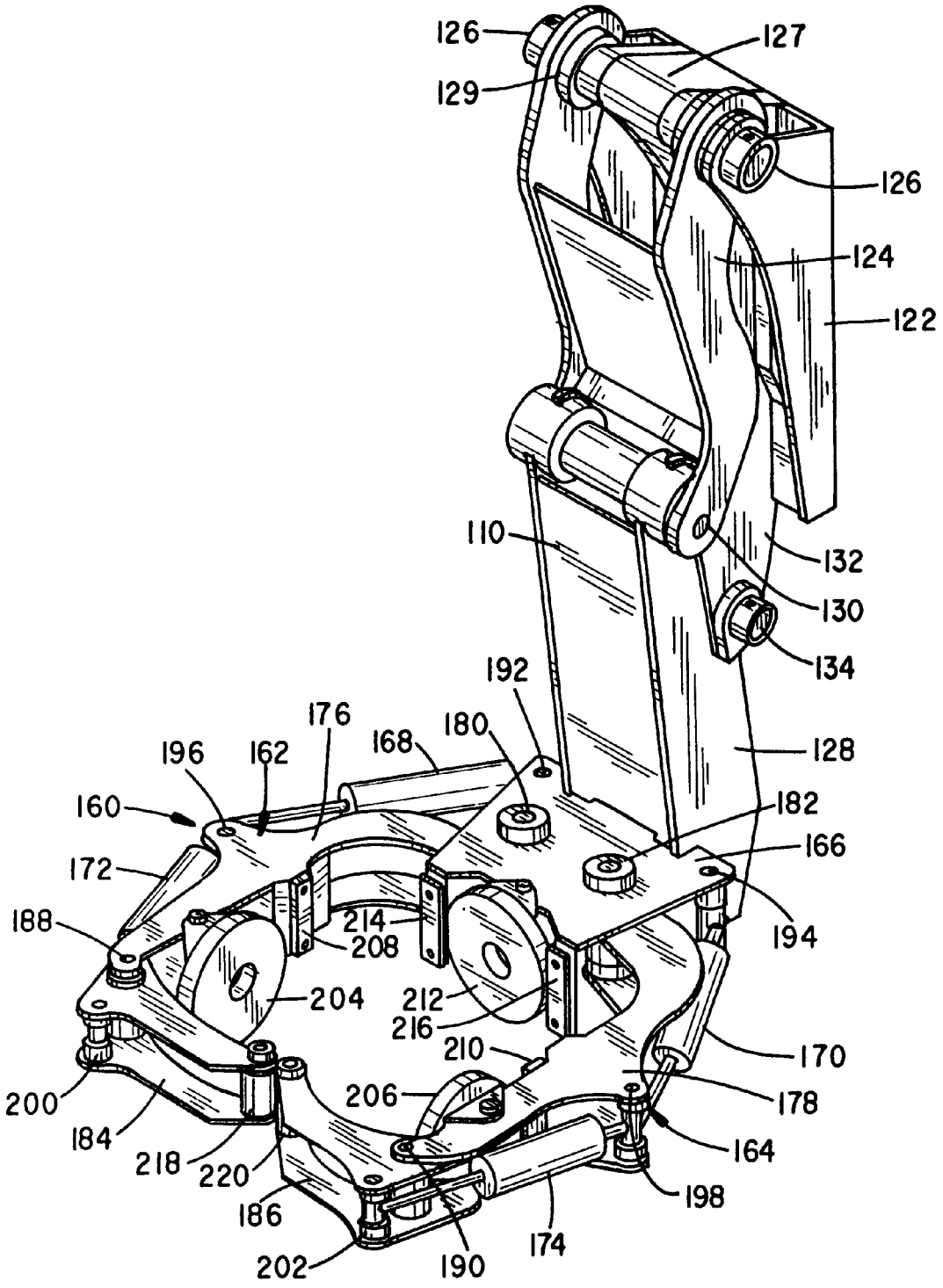
FIG. 7 is a magnified view of a supporting arm and a container grabber which may be used in accordance with the present invention.

As shown in FIG. 7, and in FIGS. 9–12 the articulated support arm 110 includes a support arm base member 122 attached to the offset support arm mount 114. A lifting arm segment 124 having two opposing sides is pivotally attached at each side to the base member 122 such as at hinged pivot joints 126. This leaves a space between the sides of the lifting arm 124 at the central axis of the pivot joints 126. The sides of the lifting arm 124 are connected together and pivotally attached to a handler base 128 at hinged pivot joint 130. A linkage bar 132 is pivotally attached at one end to the handler base 128 at 134 and at the other end to two other linkage bars 127 and 129 wherein one of the two other linkage bars 127 is pivotally attached to the lifting arm 124 and the other 129 is pivotally attached to the arm base 122. An actuator (not shown), such as an hydraulic cylinder, is pivotally attached between the arm base 122 at 135 and the three linkage bars' pivotal connection such that extending the cylinder pivots the lifting arm 124 about joint 126. One of the two linkage bars 127 provides the needed leverage to pivot the lifting arm 124 about the joint 126. As described above, the sides of the lifting arm 124 are spaced at joint 126 which allows the cylinder rod of the cylinder to extend through the axis of the joint 126 to raise the lifting arm 124. Simultaneously, the linkage bar 132 is raised to pivot the handler base 128 about hinged pivot joint 130 for unloading an engaged container. Of course, the arm base 122 remains stationary during this operation. A support arm of this type is described and shown in the above-referenced U.S. application Ser. No. 08/411,494, titled "Tilting Bin Handler". However, the invention is not limited to a support arm of this type which is considered merely exemplary and any of a variety of support arms for lifting and tipping an engaged container could be used.

Figure 8:
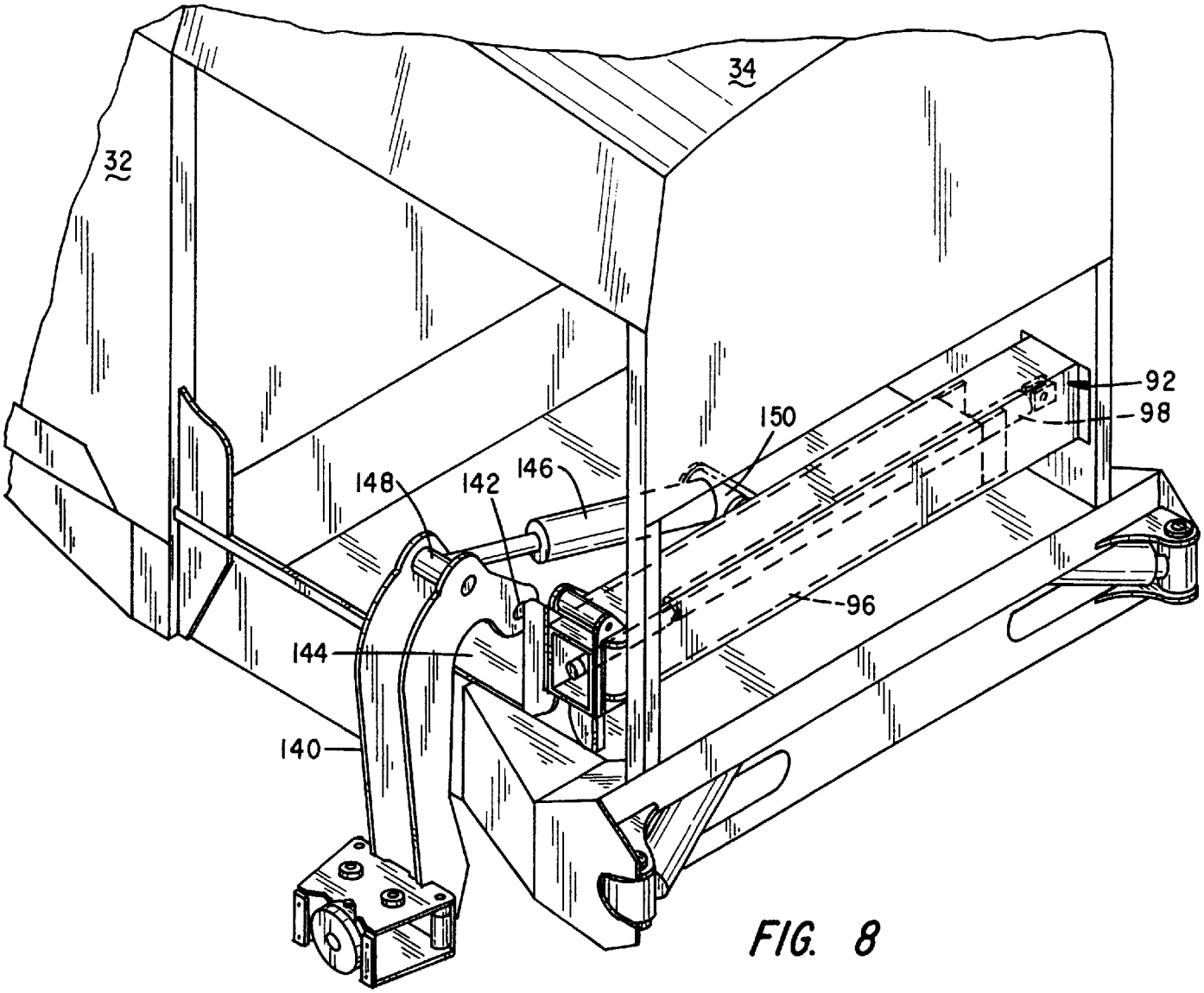
FIG. 8 is an enlarged fragmentary perspective view of the receiving hopper showing a simplified support arm carrying a container grabber and attached to the telescoping boom.

FIG. 8 depicts a simpler, alternative support arm for lifting and tipping a container of interest and includes a single lifting arm section 140 pivotally attached at pivot joint 142 to a substantial mounting plate 144. An actuator 146 is pivotally attached to the single lifting arm 140 at pivot joint 148 which is located a distance from arm pivot 142 and to the mounting plate 144 at pivot joint 150. The mounting plate 144 is attached to the inner boom arm 96 of the telescoping boom 92. Thus, extending and retracting the hydraulic cylinder 98 moves the telescoping boom arm 96, and with it the substantially horizontal mounting plate 144 which, in turn, carries the lifting arm 140 and hydraulic cylinder 146 between a stowed position and an extended position. Retracting the actuator 146 pivots the lifting arm 140 about the pivot joint 142 for lifting and emptying an engaged container. A shroud (not shown) may be provided for protecting the actuator 146 from falling refuse. Of course, any lifting arm of the present invention may be used with any container grabbing or bin handling apparatus.

FIG. 7 also illustrates a container grabber, indicated generally by the numeral 160, used with the articulated arm 110. The grabber 160 is of a type which may be used with any arm of the present invention and is shown securely attached by means of a handler or grabber base 128. The container grabber 160 includes a pair of opposed compound arms 162 and 164 which are pivotally connected at one end to a support member 166 and moved by inner arm actuators 168 and 170 and outer arm actuators 172 and 174. The actuators may be hydraulic cylinders or other such devices. As described below, expanding or retracting the actuators 168, 170, 172 and 174 operates the arms 162 and 164 between an open or retracted position as shown in FIG. 5 and a grasping position as shown in FIGS. 6 and 7.

Arms 162 and 164 have respective inner members 176 and 178 pivotally connected to support member 166 at first support pivot points 180 and 182 and to outer members 184 and 186 at arm member pivot points 188 and 190. Inner actuators 168 and 170 are pivotally connected to support member 166 at second support pivot points 192 and 194 and to inner members 176 and 178 at actuator pivot points 196 and 198. Outer actuators 172 and 174 are pivotally connected to inner members 176 and 178 at actuator pivot points 196 and 198 and to the outer members 184 and 186 at offset pivot points 200 and 202. Members 176 and 178 carry attached suction cups or main contact bumpers 204 and 206 and finger bumpers 208 and 210, respectively. A suction cup or bumper 212 and finger bumpers 214 and 216 are attached to the support member 166. Rollers 218 and 220 are rotatably attached to the outer end of outer members 184 and 186.

Expanding inner actuators 168 and 170 closes the inner members 176 and 178 around the container of interest. Likewise, expanding the outer actuators 172 and 174 causes the members 184 and 186 to pivot about pivot points 188 and 190 to contact and grasp the container of interest. A container grabber of this type and other embodiments which may be used with the present invention are described and shown in the above incorporated U.S. application Ser. No. 08/342,752, titled "Container Holding and Lifting Device". Of course, any of the grabbers described in application Ser. No. 08/342,752 may be used at the end of any of a variety of support arms, including the two described above.

Figure 9:
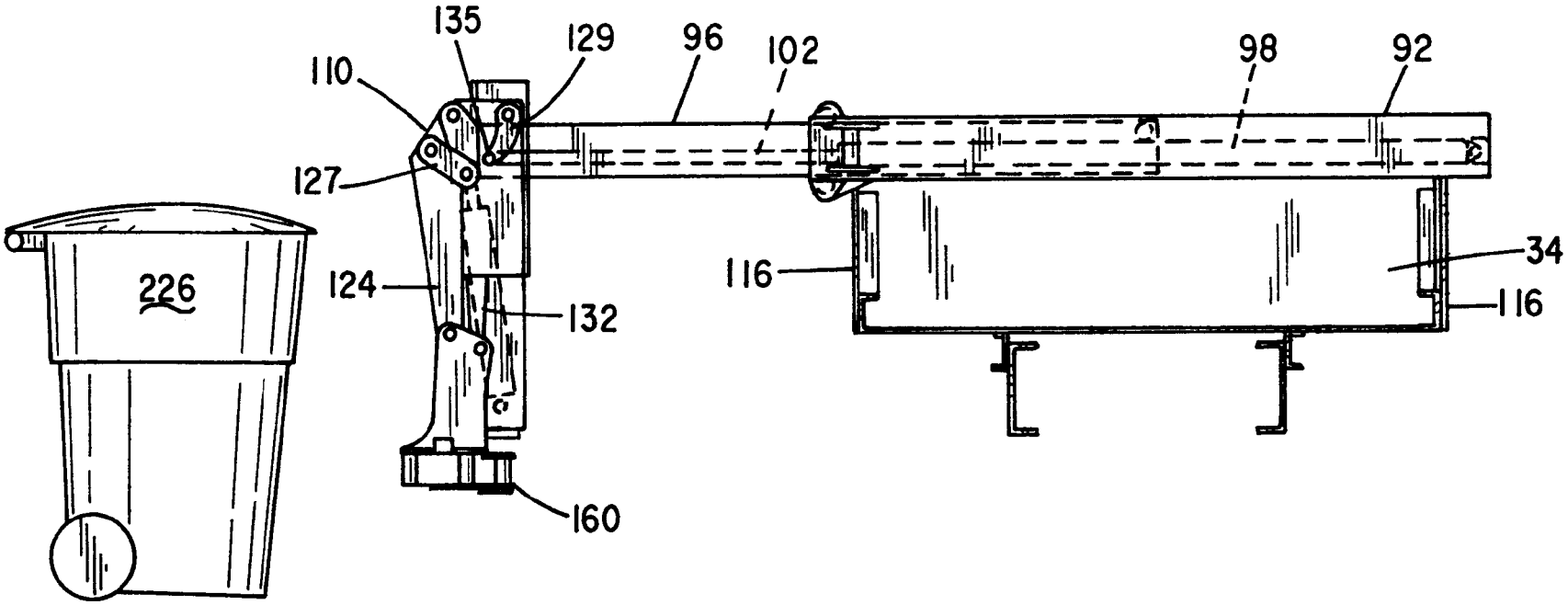
FIG. 9 is a front cross-section of the receiving hopper showing the telescoping boom partially extended and the container grabber retracted for engaging a container of interest.
Figure 10:
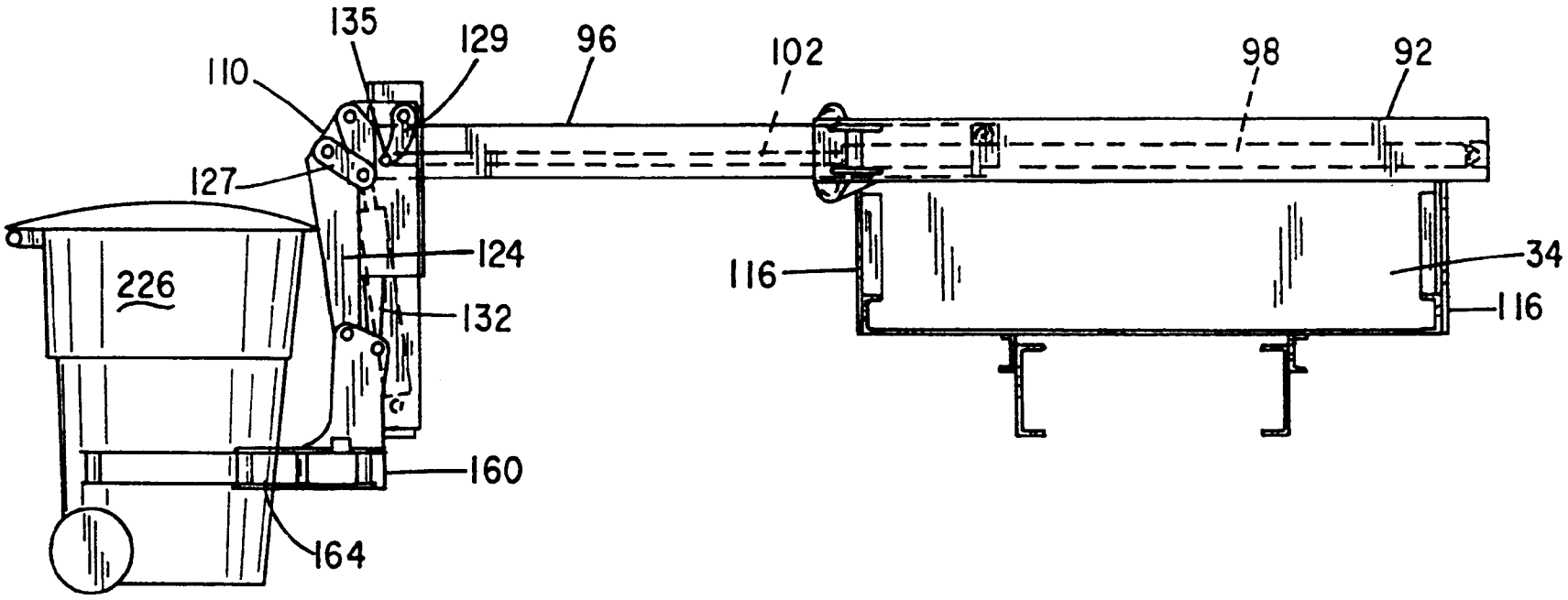
FIG. 10 is a view similar to FIG. 9 showing the telescoping boom extended and the container grabber holding a container of interest.
Figure 11:
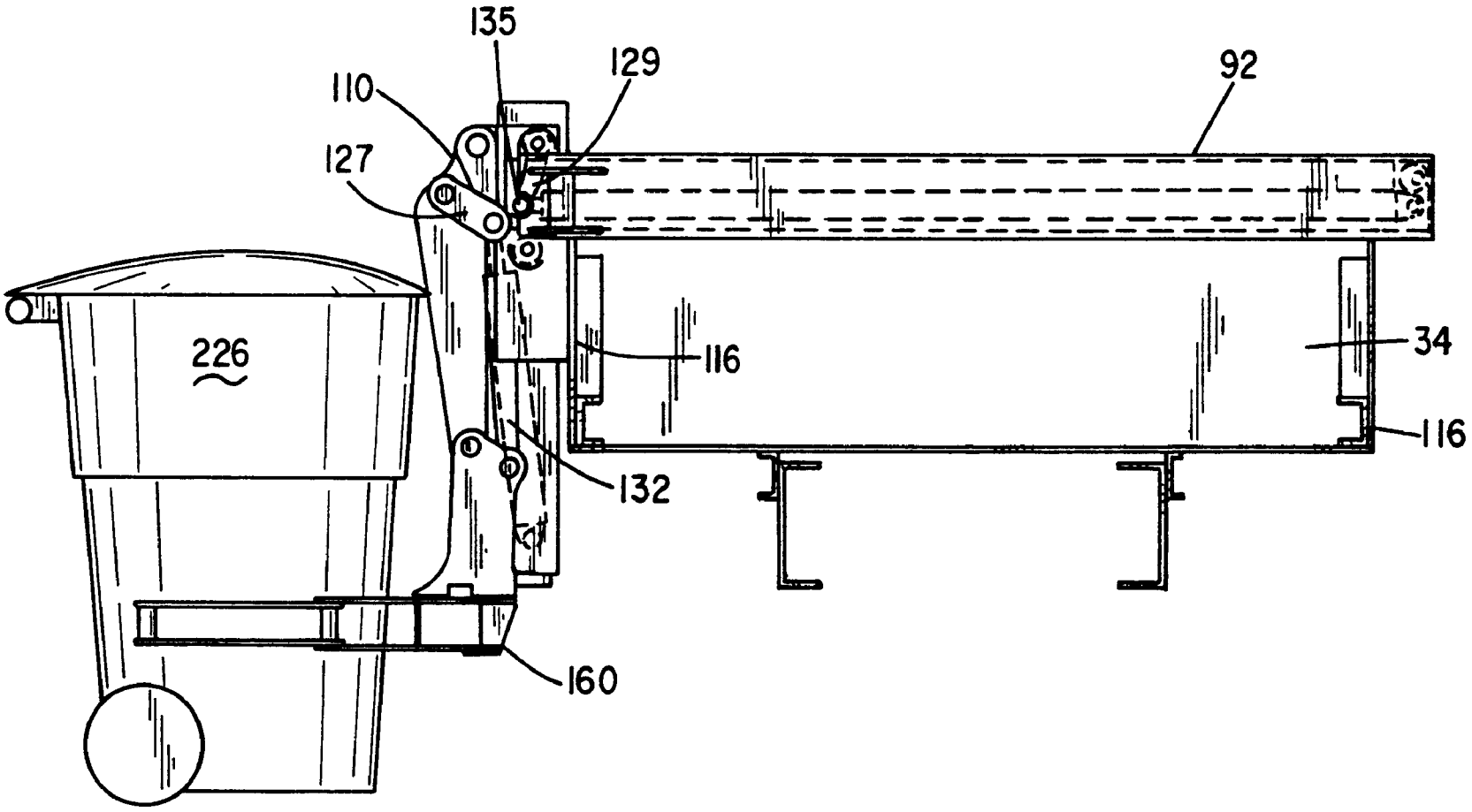
FIG. 11 is a view similar to FIG. 9 showing the telescoping boom retracted and the container grabber gripping the container of interest.
Figure 12:
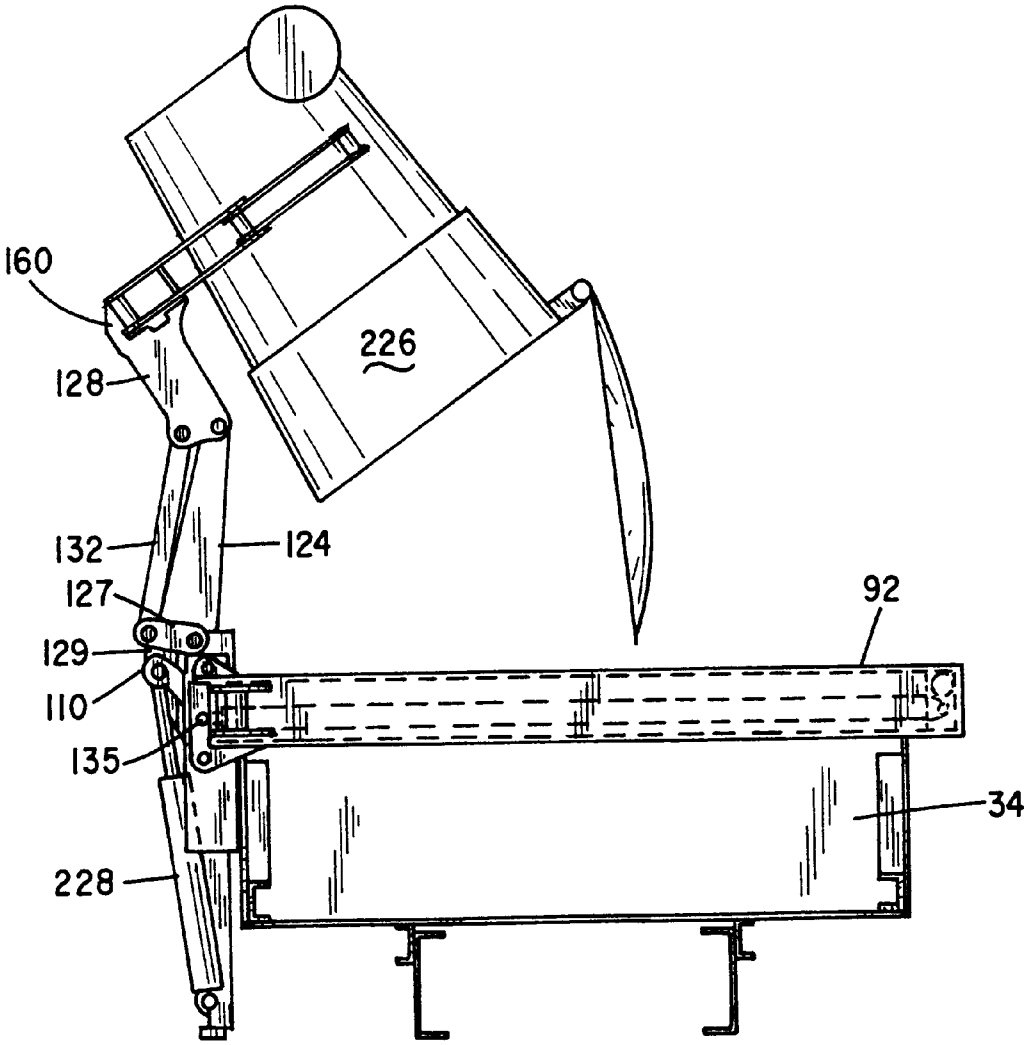
FIG. 12 is a view similar to FIG. 9 showing the support arm lifting and emptying the container of interest.

FIGS. 9–12 depict in a series of drawings the operation of container grabber 160 attached to support arm 110 which is, in turn, attached to telescoping boom 92 for extending, engaging and emptying the contents of a container 226 into receiving hopper 34. The telescoping boom 92 is securely attached to the receiving hopper side plates 116 and the support arm 110 is securely mounted to the inner boom arm 96 of the telescoping boom 92. As shown in FIG. 9, the telescoping boom cylinder 98 and rod 102 are extended to move the container grabber 160 in its retracted position to engage the container 226. The container grabber 160 is operated to move the articulated arms 162 and 164 from their retracted positions (FIG. 5) to their grabbing or holding position, FIGS. 7 and 10. The telescoping boom arm 92 is then retracted in a conventional manner to pull the container of interest 226 toward the receiving hopper 34. In this position, as shown in FIG. 11, the support arm 110 is pulled in next to the side plate 116 of the receiving hopper 34 and the container grabber 160 maintains a grip on the container of interest 226. To lift and empty the container of interest 226, the hydraulic cylinder 228 in the lifting arm 110 is extended, FIG. 12. This lifts and tilts the handler or gripper base 128 and the container 226 held by the grabber 160 is emptied into the receiving hopper 34. To return the container 226 to its previous position, hydraulic cylinder 228 is retracted and the telescoping boom 92 is extended. The container grabber is then retracted to its stowed position as is the telescoping boom arm to pull the support arm and container grabber 160 adjacent the hopper 34.

Figure 13:
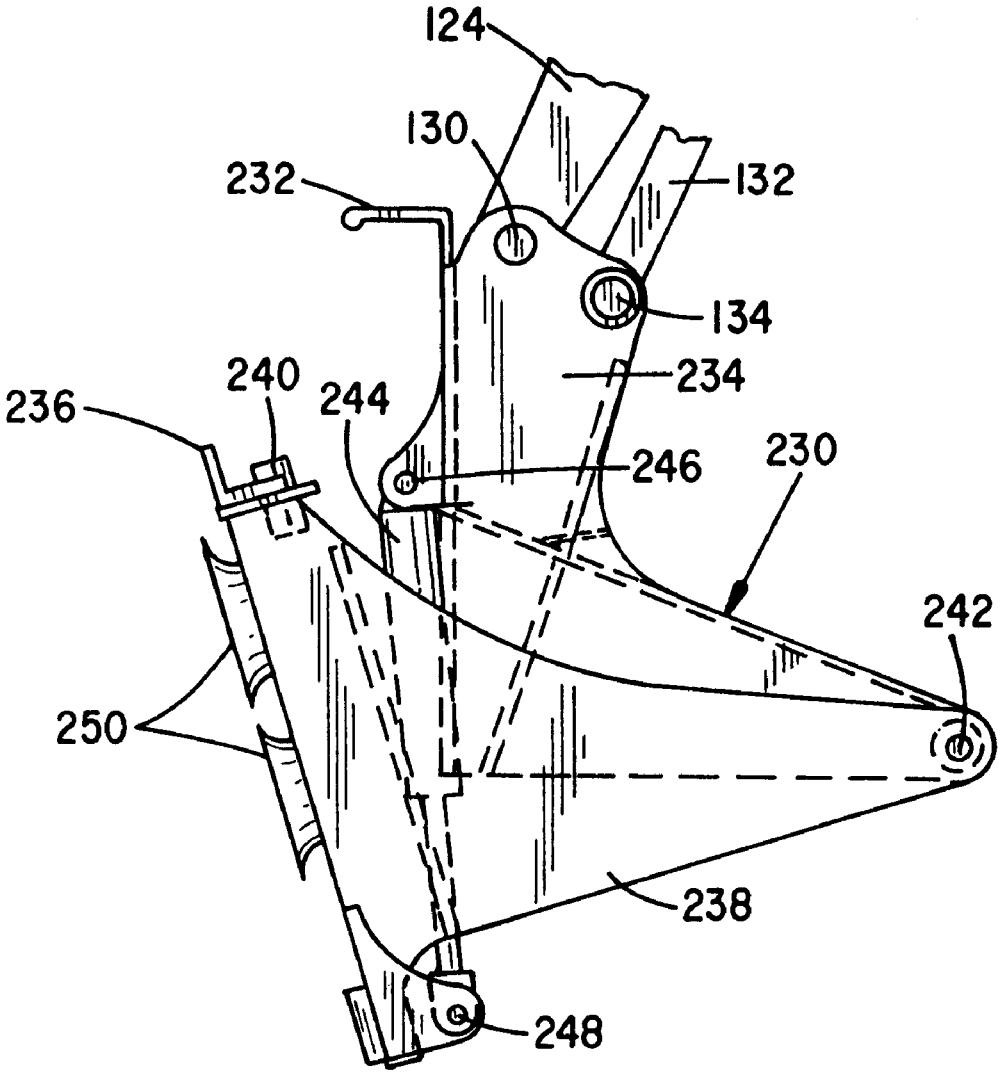
FIG. 13 is a greatly enlarged fragmentary side view of a bin handler in the open position which may be used as an alternate container handler in accordance with the present invention.
Figure 14:
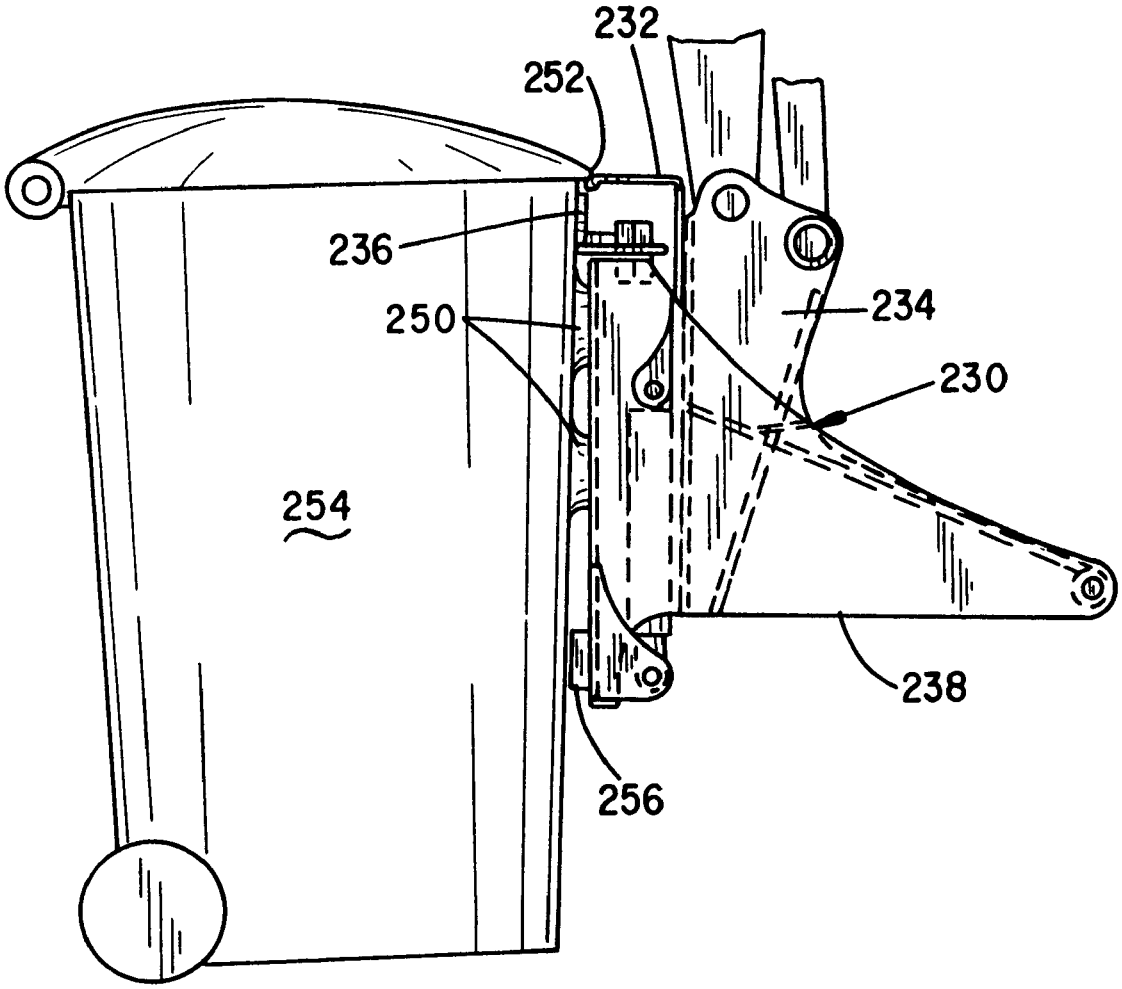
FIG. 14 is a greatly enlarged fragmentary side view of the bin handler of FIG. 13 holding a container of interest.

It will be appreciated that the present invention can make use of any of a variety of container grabbers or bin handlers. Another alternate embodiment in the form of a bin handler 230 is shown in FIGS. 13 and 14 and includes an upper gripping plate or flange 232 securely attached to the handler base member 234. A lower container engaging claw or flange 236 is attached to a swivel mount 238, such as with a bolt 240, and the swivel mount 238 is pivotally attached to the handler base 234 at hinged pivot joint 242. An actuator 244, which is preferably an hydraulic cylinder, is pivotally attached to the handler base 234 at 246 and to the swivel mount 238 at 248. Extending or retracting the actuator 244 pivots the swivel mount 238 between a lowered and a raised position, respectively. Suction cups 250 are attached to the swivel mount 238 for engaging a container of interest.

As shown in FIG. 14, the handle or rim 252 of the container 254 is trapped or snared and held between the lower flange 236 and the upper flange 232. The container 254 settles against the pair of suction cups 250, which my be active suction cups, and a bumper 256 attached to the swivel mount 238. The handle or base 234 may be attached to a support arm 110, such as the one shown in FIG. 7, wherein lifting arm 124 is connected to the handler base 234 at hinged pivot joint 130 and linkage bar 132 is pivotally connected at hinged pivot joint 134. The telescoping boom 92 and support 110 are operated as described above to lift and empty the container 254 into the receiving hopper 34.

Figure 15:
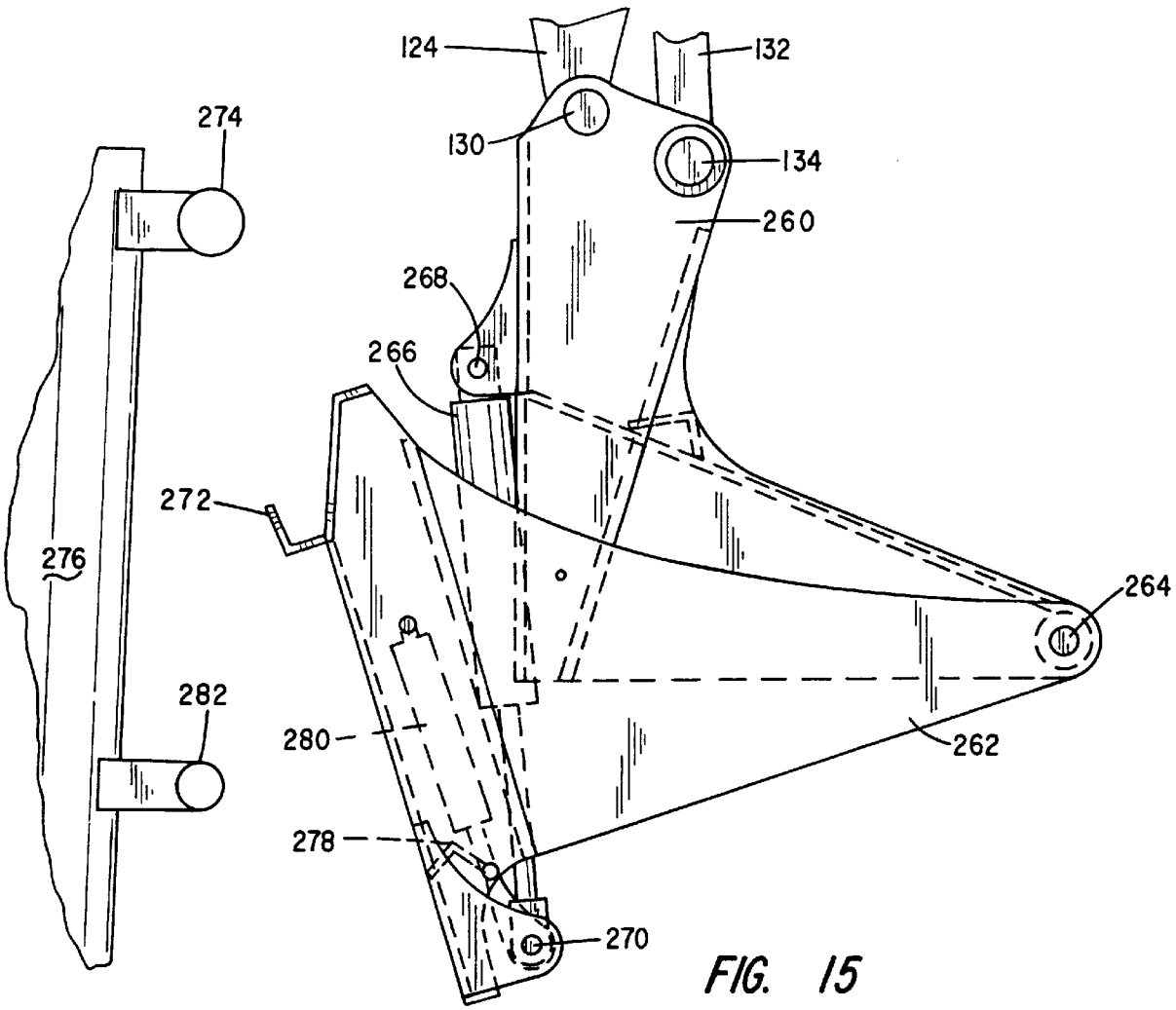
FIG. 15 is a greatly enlarged fragmentary side view of another embodiment of a bin handler for holding a container of interest by the container handles.
Figure 16:
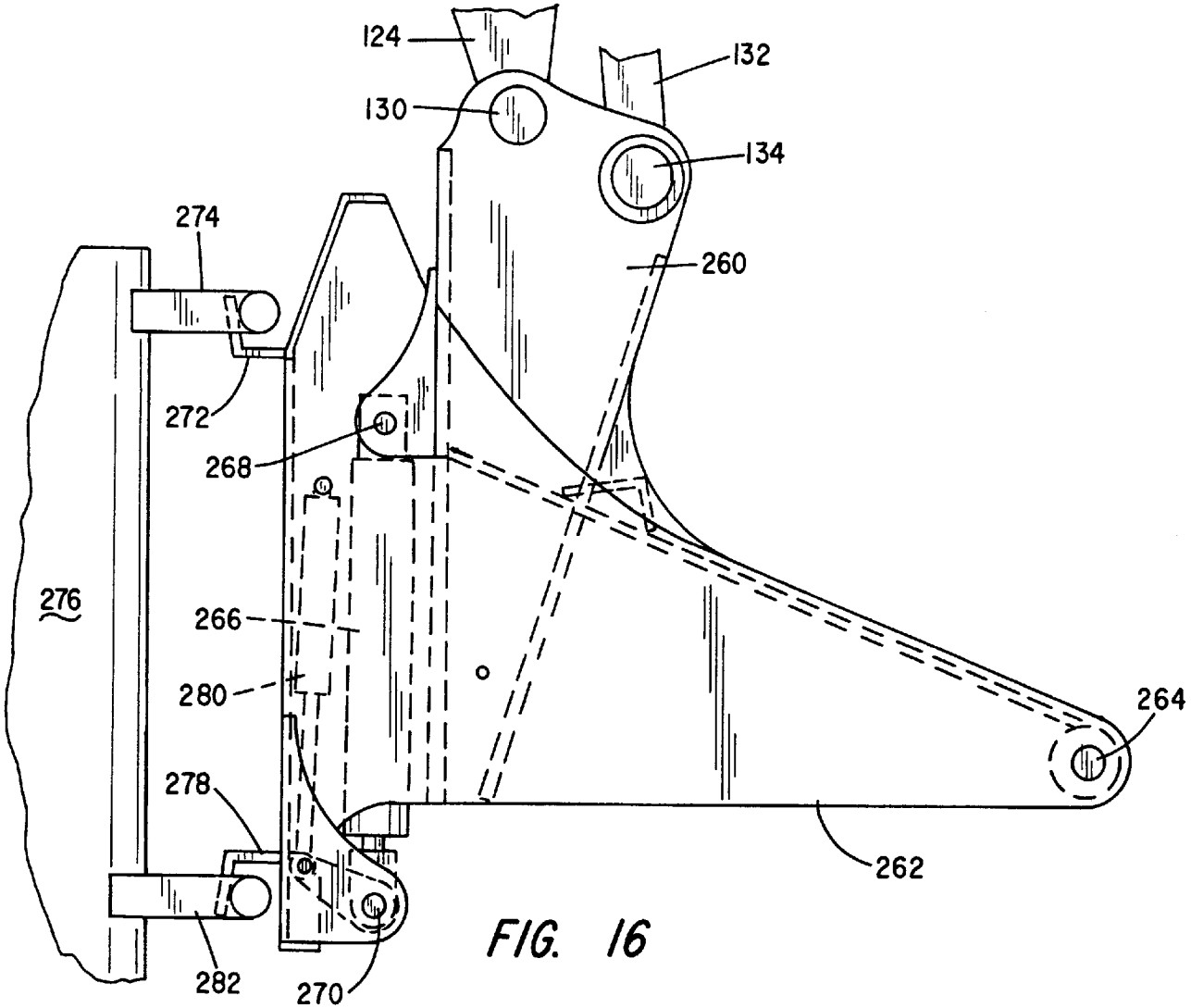
FIG. 16 is a greatly enlarged fragmentary side view of the bin handler of FIG. 15 engaging the handles of the container of interest.

Another alternate bin handler is shown in FIGS. 15 and 16. In that embodiment, a handler base 260 is pivotally attached to the lifting arm 124 and linkage bar 132 at pivot joints 130 and 134. A swivel Count 262 is pivotally attached to the handler base 260 at hinged pivot joint 264 and an actuator 266 is pivotally connected to the base 260 at 268 and to the swivel mount 262 at 270. An upper handle engaging flange 272 is securely attached to the swivel mount 262 and faces upward to engage a handle 274 on a container 276. Extending the actuator 266 lowers the swivel mount 262 and upper flange 272 below the handle 274. In this position, retracting the actuator 266 enables the upper flange 272 to engage the handle 274 and lift the container 276. A lower handle engaging flange 278 is pivotally attached to the swivel mount 262 at pivot joint 270 and biased to a retracted position by an actuator 280. The actuator 280 is preferably air operated and may be air activated to extend the second lower handle 278 with the container 276 partially lifted. Extending the actuator 280 pivots the lower flange 278 to engage the lower handle 282. The telescoping boom 92 and support arm 110 may then be operated to lift and empty the container of interest 276. Handlers of the type shown in FIGS. 13–16 are described and shown in the above-referenced U.S. application Ser. No. 08/411,494, titled "Tilting Bin Handler".

Figure 17:
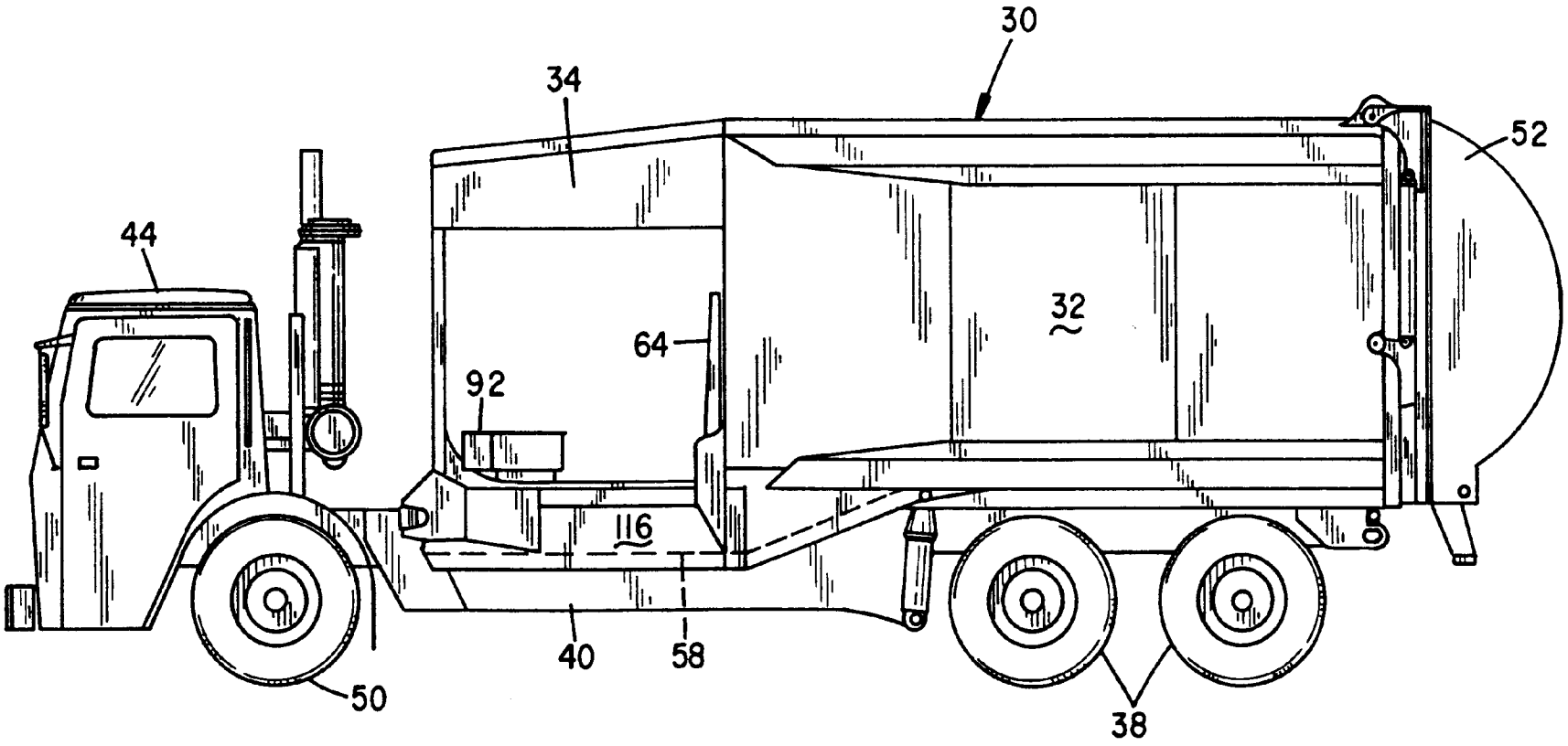
FIG. 17 is a side view of the side loading refuse truck showing the side of the refuse truck (normally the "street" side) opposite the side where the support arm and container handler are normally mounted.
Figure 18:
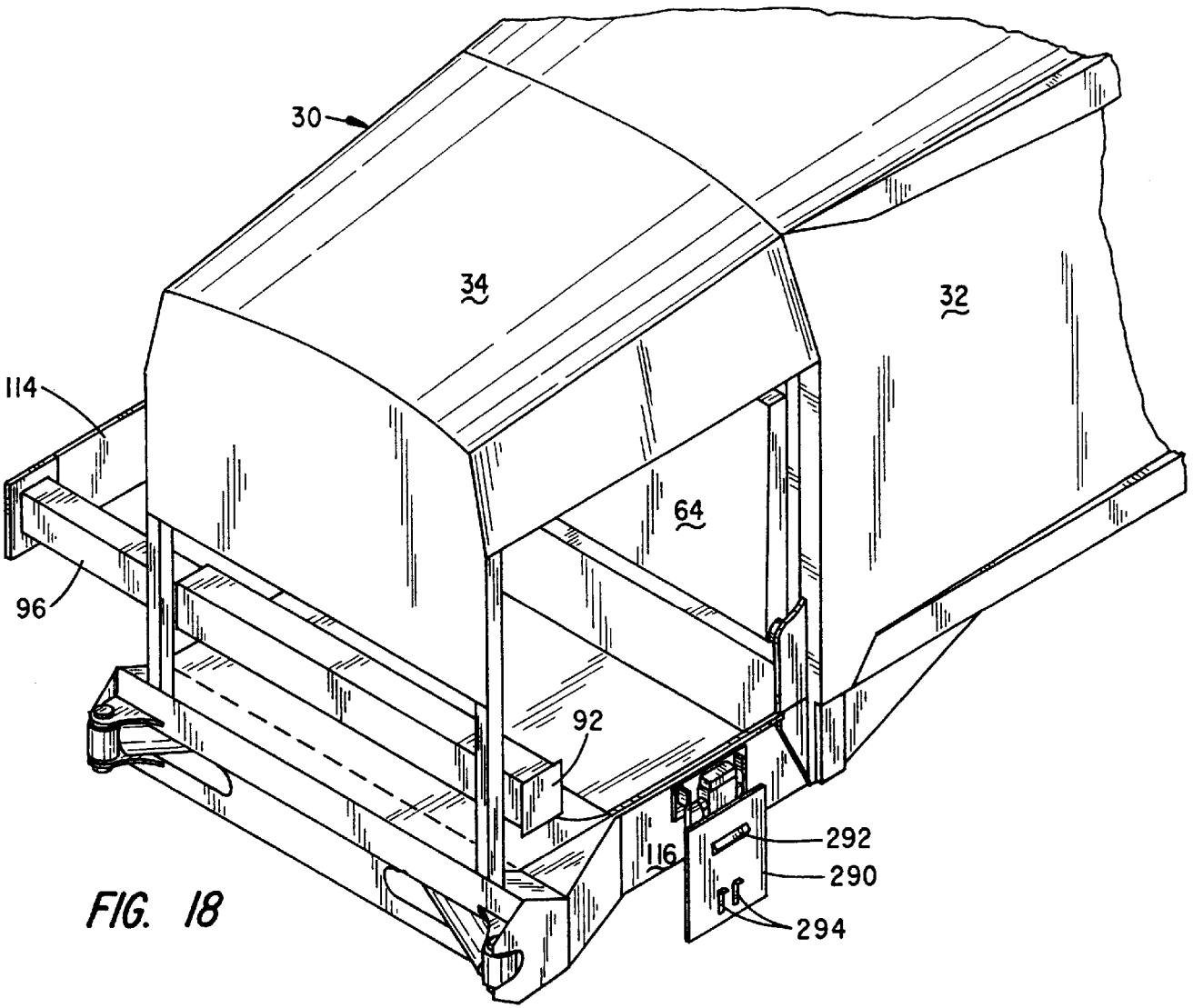
FIG. 18 in an enlarged fragmentary perspective view showing the side of the refuse truck opposite the support arm and container grabber side and showing a conventional cart tipper attached to the street side of the receiving hopper.

As shown in FIGS. 17 and 18, the side of the side loading refuse vehicle normally facing the street or "street side" which does not accommodate the inner boom arm 96 and offset support arm mount 114 carrying whatever support arm and container grabber or bin handler, may be left open for manual loading (FIG. 17), or provided with a device like a conventional, off-the-shelf, cart tipper 290 attached to the side plate 116 of the receiving hopper 34. The dropped body floor 58 and chassis 40 make it possible for the top of the side plate 116 of the receiving hopper 34 and the material receiving opening thereabove to start correspondingly closer to the ground. This makes it easier to manually throw or dump material into the receiving hopper 34. Also, the conventional cart tipper 290 is positioned correspondingly lower to the ground and it is easier to load a container of interest onto the tipper 290. A cart tipper 290 of this type includes an upper facing flange 292 and handle engaging fingers 294 which extend as the tipper lifts and empties the container of interest into the receiving hopper 34. Cart tippers of this type are well known in the art.

This invention has been described herein in considerable detail in order to comply with the Patent Statutes and to provide those skilled in the art with the information needed to apply the novel principles and to construct and use such specialized components as required. However, it is to be understood that the invention could be carried out by specifically different equipment and devices, and that various modifications, both as to the equipment details and operating procedures, can be accomplished without departing from the scope of the invention itself.

What is claimed is:

1. A load hauling vehicle, comprising:

(a) a truck chassis carrying a truck cab and a truck body;

(b) said truck body being mounted on said chassis, said truck body including a storage volume and a receiving hopper having a side opening beginning a distance from a floor of said receiving hopper for receiving material to be loaded into said storage volume, wherein said storage volume has a floor at a first level and wherein said receiving hopper is forward of said truck body and has a roof and has said floor at a second level lower than said first level thereby enabling said side opening to be at a level low enough to facilitate optional manual loading and to permit manually addressed cart tipping devices to tip carts resting on the ground and a packer mechanism situated in said receiving hopper;

(c) a ramped floor between said receiving hopper and said storage volume wherein material loaded into said receiving hopper is moved up said ramped floor and into said storage volume by said packer mechanism situated in said receiving hopper;

(d) a linearly extendable mechanized container addressing and emptying system attached to the vehicle and operable to one aide of said vehicle for addressing, lifting and emptying a container into said receiving hopper through said material receiving side opening;

(a) wherein said extendable mechanized container addressing and emptying system includes an extending boom means and wherein said extending boom means is offset toward one side of said material receiving opening to facilitate accommodation of manual loading into said material receiving side opening; and (f) wherein said extendable mechanized container addressing and emptying system includes a container manipulator means selected from the group consisting of container gripper means and bin handler means and further comprising a support arm connected between said container manipulator means and said extending boom means.

2. The vehicle as in claim 1 wherein the vehicle has a first side and a second side and wherein said extendable mechanized container addressing and emptying system includes telescoping extending boom means attached to the vehicle and laterally extendable from the first side of said vehicle and wherein said extending boom means is offset to said one side of said material receiving opening to facilitate accommodation of optional manual loading.

3. The vehicle as in claim 2 wherein said extendable mechanized container addressing and emptying system includes a container gripper means and said support arm connected between said container gripper means and said extending boom means.

4. The vehicle as in claim 2 wherein said extendable mechanized container addressing and emptying system includes a bin handler means attached to said support arm connected between said bin handler means and the extending boom means.

5. The vehicle of claim 2 further comprising a manually loaded cart tipping mechanism mounted on said second side thereof.

6. The vehicle as in claim 2 wherein said body is pivotally attached to the chassis for unloading stored material.

7. The vehicle as in claim 1 wherein said packer mechanism is one selected from the group consisting of a hydraulically operated rectangular ram and pivoting reciprocating packer paddles.

8. A refuse vehicle, comprising:

(a) a chassis having a lowered portion;

(b) a body conforming to said chassis and including a storage compartment having a floor and a receiving hopper having a roof and floor wherein said receiving hopper floor is level but dropped lower than said storage compartment floor and supported by said lowered portion;

a ramped transition floor between said receiving hopper floor and said storage compartment floor and further comprising a packer situated in said receiving hopper wherein material loaded into said receiving hopper is moved up said ramped transition floor and into said storage compartment by said packer situated in said receiving hopper;

(d) container unloading including side-extensible telescoping boom disposed in a forward portion of said receiving hopper for loading material into said receiving hopper and a container manipulator (e) offset mounting member for mounting said container manipulator to and offset from said extensible boom so that said container manipulator deposits material closer to the center of said hopper yet allows for optional manual loading next thereto without interference from said boom.

9. A side loading waste material hauling vehicle, comprising:

(a) a chassis carrying a truck cab and a truck body;

(b) said truck body being mounted on said chassis, said truck body including a storage compartment defining a storage volume and having a roof and a floor and a receiving hopper having a floor, wherein the floor of said receiving hopper is flat and dropped to a lower level than the floor of said storage compartment, said receiving hopper having a side material receiving opening;

(c) a ramped transition floor between said receiving hopper and said storage compartment and further comprising a packer situated in said receiving hopper wherein material loaded into said receiving hopper is moved up said ramped transition floor and into said storage compartment by said packer situated in said receiving hopper;

(d) a linearly extensible mechanized container addressing and emptying system including means attached to the vehicle for accessing, lifting and emptying a container into said receiving hopper through said side material receiving opening; and (e) wherein the lower level of said floor of said receiving hopper relative to the floor of said storage compartment enables said side material receiving opening to be at a level sufficiently lower to accommodate optimal manual loading and to permit the use of manually addressed container tipping devices to tip containers resting on the ground.

10. The vehicle as in claim 9 wherein said packer is one selected from the group consisting of a hydraulically operated rectangular ram and a pivoting reciprocating packer paddle.

11. The vehicle as in claim 9 wherein said truck body is pivotally attached to the chassis for unloading stored material.

* * * * *